US012575629B1

(12) United States Patent
Cousino

(10) Patent No.: US 12,575,629 B1
(45) Date of Patent: Mar. 17, 2026

(54) REMOVABLE COVER FOR SUN PROTECTION ON STRAW HATS

(71) Applicant: Jeffrey Cousino, Winter Park, FL (US)

(72) Inventor: Jeffrey Cousino, Winter Park, FL (US)

( * ) Notice: Subject to any disclaimer, the term of this patent is extended or adjusted under 35 U.S.C. 154(b) by 0 days.

(21) Appl. No.: 18/773,315

(22) Filed: Jul. 15, 2024

Related U.S. Application Data

(60) Provisional application No. 63/527,636, filed on Jul. 19, 2023.

(51) Int. Cl.
*A42B 1/18* (2006.01)
*A42B 1/22* (2006.01)
*A42B 7/00* (2006.01)

(52) U.S. Cl.
CPC ..... *A42B 1/18* (2013.01); *A42B 1/22* (2013.01); *A42B 7/00* (2013.01)

(58) Field of Classification Search
CPC ..... A42B 1/18; A42B 1/22; A42B 7/00
See application file for complete search history.

(56) References Cited

U.S. PATENT DOCUMENTS 730,969 A * 6/1903 Ribaud ..... A42B 7/00 132/57.1
1,163,287 A * 12/1915 Van Raalte ..... A42B 5/00 D2/891
1,706,205 A * 3/1929 Alonzo ..... A42B 1/18 2/172
2,728,913 A * 1/1956 Connor ..... A42B 3/225 2/10
4,993,079 A * 2/1991 Johnson ..... A42B 7/00 2/418
5,048,128 A * 9/1991 Watson, Jr. ..... A42B 1/0186 2/202
5,153,943 A * 10/1992 Clement ..... A42B 1/0187 2/418
5,669,074 A 9/1997 Newman, Jr.
5,694,647 A * 12/1997 Crickmore ..... A42B 1/0187 2/172
5,857,219 A * 1/1999 Edmark ..... A42B 1/201 2/182.2

(Continued)

FOREIGN PATENT DOCUMENTS

CN 203723503 7/2014

*Primary Examiner* — Khaled Annis
(74) *Attorney, Agent, or Firm* — Malloy & MAlloy, P.L.; Rafay Asrar

(57) ABSTRACT

The present invention relates to an adjustable removable cover for sun protection on straw hats. The inventive cover is designed to shield the wearer's neck from direct sunlight while offering flexibility and convenience. The cape/cover comprises a semipermeable and stretchy fabric material that provides a comfortable fit and allows for optimal airflow. It features an attachment mechanism, such as hook and loop fasteners, snap buttons, or magnetic closures, for secure and easy fastening to the straw hat. The adjustable design allows for resizing and accommodating various hat sizes and shapes. Additionally, the cover can be folded and stored in a built-in pouch for compact storage. The present invention provides a practical solution to protect the wearer's neck from sunburn, with its versatile design, comfortable materials, and convenient storage capabilities.

18 Claims, 7 Drawing Sheets

(56) References Cited

U.S. PATENT DOCUMENTS 5,875,493 A * 3/1999 MacDonald ..... A42B 1/205 2/171.1
5,884,334 A 3/1999 Collette et al.
6,233,745 B1 5/2001 Friesen
6,260,204 B1 * 7/2001 Morrissey ..... A42B 3/003 2/172
6,260,208 B1 * 7/2001 Wang ..... A42B 1/0182 2/171.03
D732,243 S 6/2015 Votel et al.
11,317,670 B2 * 5/2022 Davis ..... A42B 1/0186
11,375,765 B2 * 7/2022 Bryan ..... A42B 3/0406
11,825,899 B2 * 11/2023 Michaels ..... A42B 1/018
2002/0035745 A1 * 3/2002 Spell ..... A61F 7/103 2/209.13
2006/0174396 A1 8/2006 Rosas
2006/0212995 A1 * 9/2006 Collins ..... A42B 1/0186 2/175.6
2008/0066216 A1 * 3/2008 Yun ..... A42B 1/0187 2/172
2010/0031425 A1 * 2/2010 Klamerus, Jr. ..... A42B 1/18 2/209.13
2011/0034887 A1 * 2/2011 Forden ..... D06M 15/333 607/114
2011/0094013 A1 4/2011 Zumwalt et al.
2011/0099692 A1 * 5/2011 Essex ..... A45B 23/00 2/184.5
2015/0113707 A1 * 4/2015 Tsai ..... A42B 1/004 2/209.13
2016/0157548 A1 * 6/2016 Copeland ..... A42B 3/32 2/425
2017/0079360 A1 * 3/2017 Sharrad ..... A42B 1/048
2018/0146734 A1 * 5/2018 Kelly ..... A42B 1/004
2018/0271195 A1 * 9/2018 Noa ..... A42B 1/0187
2019/0297982 A1 * 10/2019 Denny ..... A42B 1/004
2019/0387827 A1 12/2019 Hylton
2020/0253311 A1 * 8/2020 Niedermeyer ..... A42B 1/14
2020/0256009 A1 * 8/2020 Altman ..... C09D 189/00
2021/0100307 A1 * 4/2021 Sunseri ..... A42B 1/18
2021/0259345 A1 * 8/2021 Michaels ..... A42B 1/22
2022/0143243 A1 * 5/2022 Chen ..... A61L 2/18
2022/0192303 A1 * 6/2022 Tezcucano Boy ... A42B 1/0195
2022/0256957 A1 * 8/2022 Nakamura ..... A42B 1/0187
2022/0330643 A1 * 10/2022 New ..... A41D 20/00
2024/0180284 A1 * 6/2024 Bronson ..... A42B 3/227

* cited by examiner

REMOVABLE COVER FOR SUN PROTECTION ON STRAW HATS

CLAIM OF PRIORITY

This application claims the benefit of U.S. Provisional Patent Application 63/527,636 filed on Jul. 19, 2023, which is incorporated by reference herein in its entirety.

BACKGROUND OF THE INVENTION

Field of the Invention

The field of the present invention relates to headwear accessories and, more specifically, to addressing the issue of sun protection for individuals wearing straw hats or hats of similar dimensions. The invention aims to provide an improved solution to protect the wearer's neck from direct sunlight, reducing the risk of sunburn and skin damage.

DESCRIPTION OF THE RELATED ART

Spending time outdoors, especially in sunny environments, exposes individuals to harmful ultraviolet (UV) radiation, increasing the risk of sunburn and long-term skin damage. While straw hats offer some shade to the face, they often leave the sensitive neck area exposed and vulnerable to direct sunlight. To address this issue, various sun protection accessories have been developed, but they come with limitations that hinder their effectiveness.

One of the commonly used solutions is the attachment of fabric extensions or capes to the back of the hat, designed to cover the wearer's neck. These extensions are typically made of lightweight and breathable materials that provide additional shade and minimize direct exposure to the sun. However, the prior art suffers from several drawbacks that limit their practicality and effectiveness.

Firstly, many existing fabric extensions are permanently sewn onto the hat, making them inseparable and non-removable. This limitation restricts the flexibility of the hat, as users are unable to remove the extension when it is not needed or desired. Additionally, permanently attached extensions make hat maintenance and cleaning more challenging, as the entire hat needs to be washed, risking potential damage to the hat's construction or embellishments.

Furthermore, some prior art solutions offer removable fabric extensions but rely on complex attachment mechanisms that are cumbersome to use. These mechanisms often involve multiple hooks, buttons, or clips that need to be fastened securely, which can be time-consuming and frustrating for users. The complexity of the attachment mechanism also increases the risk of the extension becoming loose or detaching during movement, compromising its effectiveness in providing sun protection.

Moreover, certain fabric extensions lack versatility in terms of adjustability and compatibility with different hat sizes and shapes. A one-size-fits-all approach may result in poor fitting and instability, as the extension may not securely cover the entire neck area or may slip off easily. This limitation restricts the accessibility and usability of the sun protection accessory for individuals with various head sizes or different hat styles.

Another issue with some existing solutions is the lack of breathability and comfort in the fabric materials used. Excessive heat buildup and inadequate ventilation can cause discomfort and excessive perspiration, reducing the overall wearability of the accessory. Furthermore, non-breathable materials may trap moisture, leading to unpleasant odors or the growth of bacteria, compromising hygiene and cleanliness.

In addition to the practical limitations, the aesthetic aspect of sun protection accessories is often overlooked. Many prior art solutions lack appealing designs, patterns, or customization options, limiting individual expression and style preferences. The unattractive or generic appearance of these accessories may deter individuals from using them, especially in social or fashion-conscious settings.

Therefore, there is a need for an improved sun protection accessory that overcomes the drawbacks of the prior art and provides a practical, comfortable, and aesthetically pleasing solution. Such an accessory should offer removable functionality, easy attachment and removal, compatibility with various hat sizes and shapes, breathability, and customization options to enhance user experience and encourage regular use.

In summary, the prior art in sun protection accessories for straw hats or hats of similar dimensions has limitations that reduce their practicality, effectiveness, and user appeal. The need for a removable, easy-to-use, adjustable, breathable, and customizable solution is evident to provide comprehensive sun protection for the wearer's neck. The present invention aims to address these shortcomings and offer an improved headwear accessory that fulfills the requirements of practicality, comfort, and style in sun safety.

SUMMARY OF THE INVENTION

The present invention introduces an innovative and highly functional solution in the form of an adjustable removable cape/cover specifically designed for straw hats. This sun protection accessory revolutionizes the way individuals shield their necks from harmful sun rays by offering a range of unique and pertinent features. The completely removable design allows users to effortlessly attach or detach the cape/cover as needed, providing unmatched flexibility and convenience. Unlike the permanent extensions found in some prior art solutions, the present invention enables easy maintenance and cleaning of the hat without compromising its structural integrity. The user-friendly attachment mechanism ensures a secure fit without the need for complex fastening systems, enhancing usability and practicality. With its adjustability to accommodate various hat sizes and shapes, the present invention guarantees a universal fit, catering to a diverse range of users. The clever use of breathable and comfortable materials allows for optimal airflow and ventilation, keeping the wearer cool and dry even in warm weather conditions. Moreover, the present invention offers a wide range of customization options, including an array of appealing designs and patterns, allowing individuals to express their unique style preferences. With its exceptional combination of practicality, versatility, and aesthetic appeal, the present invention provides an effective, comfortable, and stylish means of shielding the wearer's neck from the sun's harmful rays, making it an indispensable accessory for outdoor enthusiasts and fashion-conscious individuals alike The present invention offers significant advantages over the prior art in sun protection accessories for straw hats. It features a completely removable design, allowing users to attach or detach the cape/cover as needed, providing flexibility and convenience. Unlike the permanently sewn extensions found in some prior art solutions, the present invention allows for easy maintenance and cleaning of the hat. The improved attachment mechanism ensures a secure fit without the complexities of cumbersome fastening systems, making it user-friendly and efficient. The adjustable nature of the invention accommodates various hat sizes and shapes, providing a universal fit and enhancing versatility and accessibility. The use of breathable and comfortable materials ensures optimal airflow and ventilation, reducing perspiration and enhancing overall comfort during use. Additionally, the present invention offers a wide range of customization options, including various designs and patterns, allowing users to express their style preferences and integrate the sun protection accessory seamlessly into their fashion choices. With its combination of practicality, comfort, and style, the present invention stands out as an innovative and superior solution for individuals seeking effective sun protection for their straw hats.

In a first implementation of the invention, an adjustable and removable cover for sun protection on straw hats comprises a semipermeable and stretchy fabric material configured to shield the wearer's neck from direct sunlight. It includes an attachment mechanism adapted for secure and easy fastening of the cover to the straw hat, ensuring that the cover remains in place even during active movement. Additionally, the cover features an adjustable design that allows for resizing and accommodating various hat sizes and shapes. This cover is completely removable, enabling users to attach or detach it as desired, thus enhancing flexibility and convenience for different outdoor conditions and personal preferences.

In a second aspect, the semipermeable and stretchy fabric material may be quick-drying.

In another aspect, the attachment mechanism may comprise hook and loop fasteners.

In another aspect, the attachment mechanism may comprise snap buttons.

In another aspect, the attachment mechanism may comprise magnetic closures.

In another aspect, the adjustable design may include a drawstring or elastic cord for resizing.

In another aspect, the adjustable design may include adjustable straps or buckles for resizing.

In another aspect, the fabric material may comprise a UV-protective coating.

In another aspect, the fabric material may comprise a moisture-wicking property. In another aspect, the fabric material may comprise antimicrobial properties.

In another aspect, the fabric material may comprise a UPF (Ultraviolet Protection Factor) rating.

In another aspect, the fabric material may comprise a lightweight and breathable mesh construction.

In another aspect, the customization options may include a variety of colors.

In another aspect, the customization options may include patterns or prints.

In another aspect, the customization options may include embroidered designs.

In another aspect, the customization options may include interchangeable decorative patches or accessories.

In another aspect, the cape/cover further comprises a storage pouch for compact and convenient storage when not in use.

In another implementation of the invention, a method of using an adjustable removable cape/cover for sun protection on straw hats comprises several steps. First, a straw hat with a removable cape/cover, made from a semipermeable and stretchy fabric material, is provided. The cape/cover is then securely attached to the straw hat using an attachment mechanism designed for easy and secure fastening. The user adjusts the cape/cover to resize and accommodate the specific hat size and shape. The hat, with the attached cape/cover, is worn to ensure that the wearer's neck is shielded from direct sunlight. The wearer can then enjoy outdoor activities while benefiting from the sun protection provided by the cape/cover. When sun protection is no longer needed, the cape/cover can be optionally removed from the straw hat. Finally, the removable cape/cover is stored in a convenient and compact manner when not in use.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENT

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention provides an adjustable removable cover for sun protection on straw hats. In the following description, numerous specific details are set forth to provide a more thorough understanding of the invention. However, it will be apparent to one skilled in the art that the invention may be practiced without these specific details. In other instances, well-known features have not been described in detail to avoid unnecessarily obscuring the invention.

Figure 1:
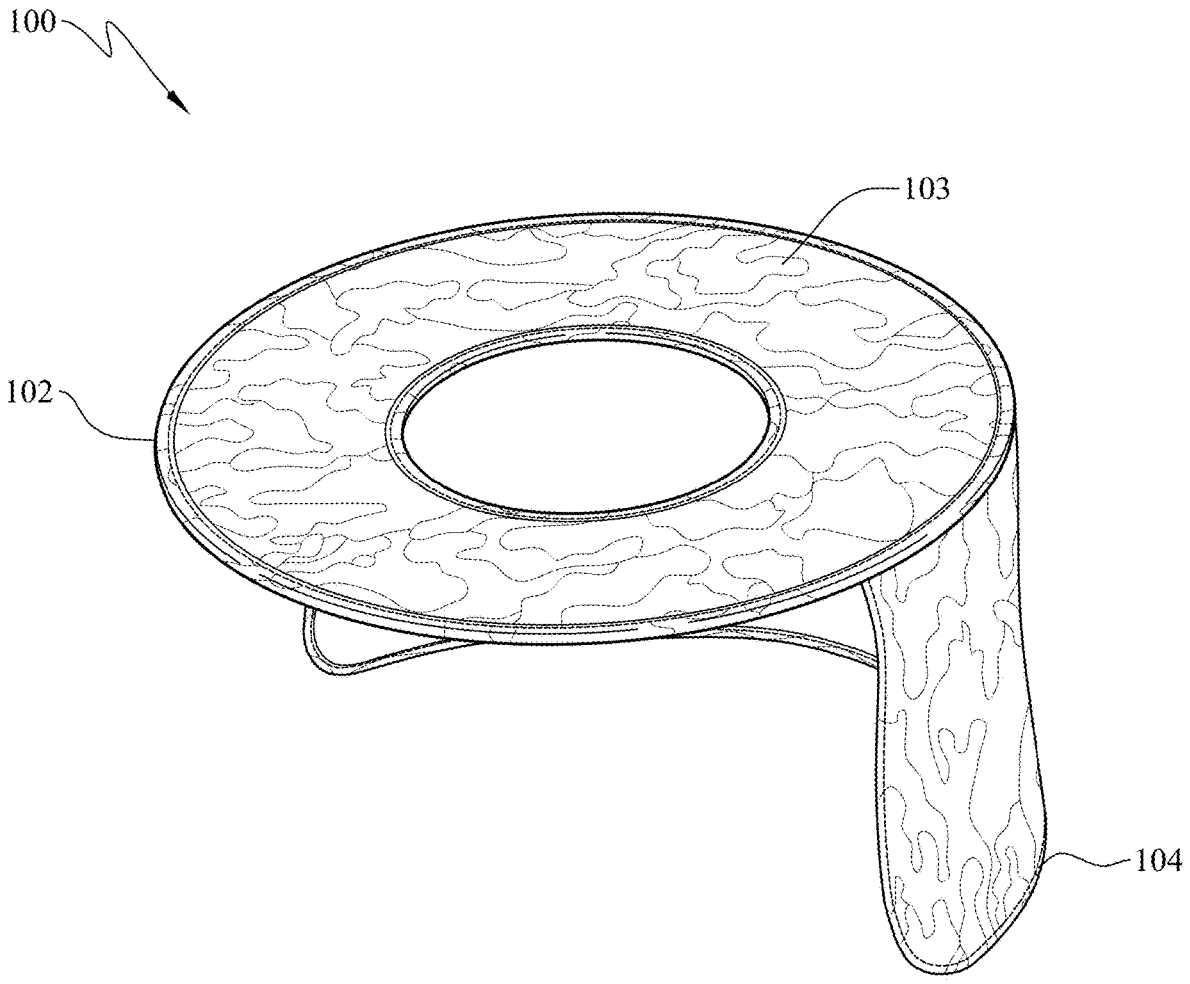
FIG. 1 presents a perspective view of a removable cover for sun protection on straw hats, in accordance with a first illustrative embodiment of the invention.

FIG. 1 presents a perspective view of a removable cover 100 for sun protection on straw hats, in accordance with a first illustrative embodiment of the invention. The removable cover 100 is designed to be attached to a straw hat and provides sun protection to the wearer's neck. The cover 100 includes a brim portion 102 and a neck portion 104.

Figure 2:
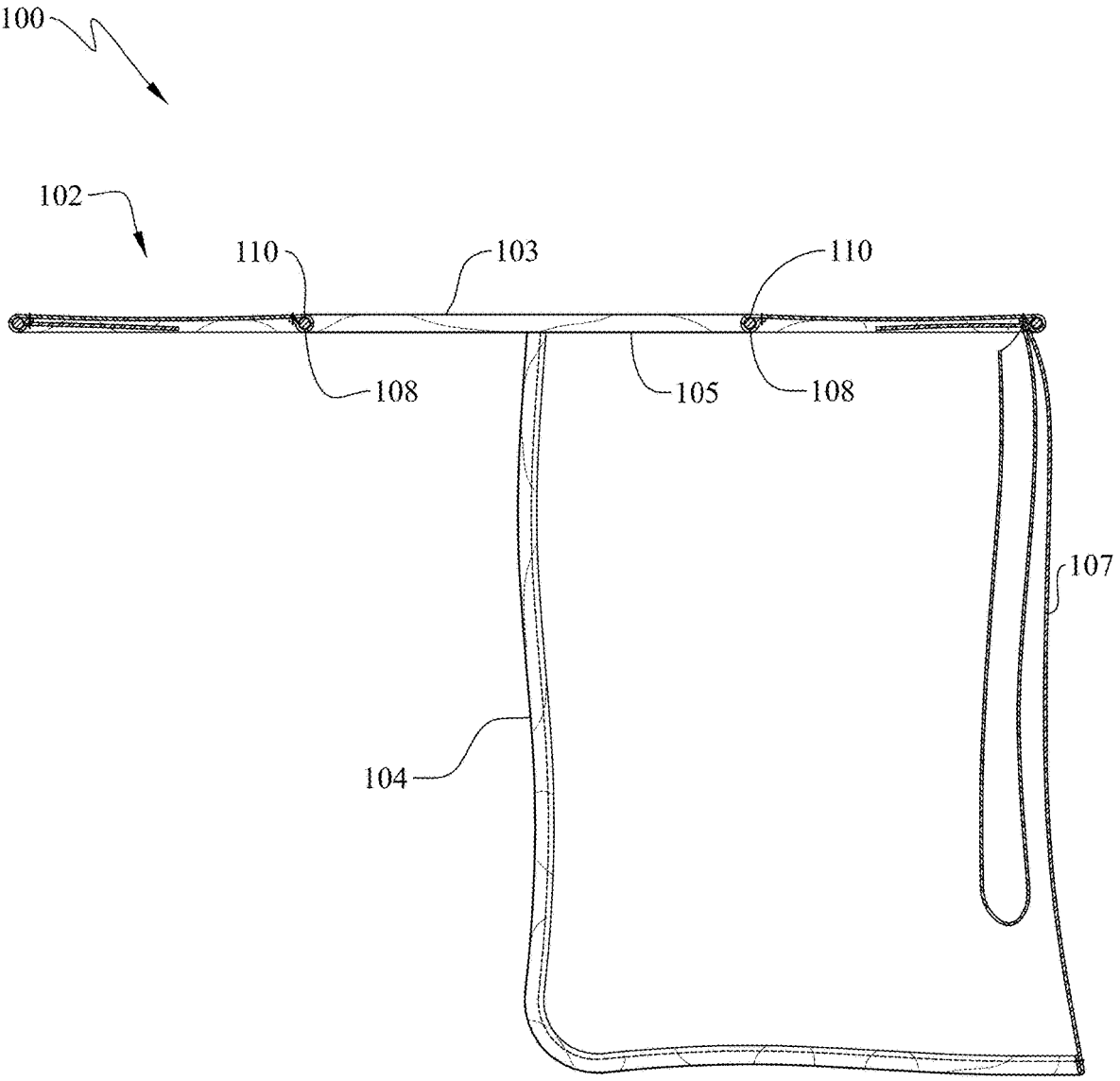
FIG. 2 presents a cross-sectional side view of the removable cover illustrated in FIG. 1.

Referring to FIG. 2, a cross-sectional side view of the removable cover 100 is shown. The cover 100 is made of a semipermeable and stretchy fabric material that provides a comfortable fit and allows for optimal airflow. The fabric material is quick-drying, ensuring that the cover 100 remains dry even during sweaty or humid conditions. The cover 100 is designed to cover both the top surface 103 and the bottom surface 105 of the brim of the straw hat, offering comprehensive sun protection.

Also shown in FIG. 2, the cover further includes a drawstring 107 feature that enhances the adjustability and secure fit of the removable cover 100. The drawstring 107 is integrated into the design of the cover and allows users to easily resize and tighten the cover according to their specific needs and preferences. By pulling the drawstring 107, the cover 100 can be snugly secured around the straw hat, ensuring that it stays in place even during movement or windy conditions. The drawstring 107 feature provides added versatility, accommodating different head sizes and shapes, and allows for a personalized fit that maximizes comfort and sun protection. Its intuitive and user-friendly design ensures that adjusting the cover is a simple and hassle-free process. With the drawstring 107 feature, the cover 100 provides a customizable and secure solution to shield the wearer's neck from the sun's harmful rays.

The semipermeable fabric material used in the cover 100 has been carefully selected to strike a balance between sun protection and breathability. It effectively blocks a significant portion of the sun's harmful UV rays while allowing air to circulate through the material. This ensures that the wearer's neck remains protected from sunburn while maintaining a comfortable and cool environment.

The stretchiness of the fabric material allows the cover 100 to snugly fit a variety of straw hats with different brim sizes and shapes. The elasticity of the material ensures a secure and flexible attachment, preventing the cover from slipping or shifting during outdoor activities. The fabric material is also durable and resilient, capable of withstanding frequent use and maintaining its shape over time.

To securely attach the cover 100 to the straw hat, an attachment mechanism is provided. In the depicted embodiment, the attachment mechanism comprises hook and loop fasteners. FIG. 1 shows hook fasteners 108 attached to the inside of the brim portion 102, while loop fasteners 110 are sewn onto the outside of the straw hat's brim. This configuration allows the hook and loop fasteners to interlock when the cover 100 is placed on the hat, providing a secure and reliable attachment.

Alternatively, the attachment mechanism can be implemented using snap buttons, which are well-known in the art. In this configuration, one part of the snap buttons would be sewn onto the inside of the cover 100, while the corresponding part would be affixed to the outside of the straw hat's brim. The snap buttons can be easily fastened and unfastened, ensuring a secure fit and ease of use.

In yet another embodiment, the attachment mechanism may utilize magnetic closures. Small magnets can be embedded within the fabric material of the cover 100 and the straw hat's brim. When the cover 100 is placed on the hat, the magnetic closures attract each other, holding the cover securely in place.

Figure 3:
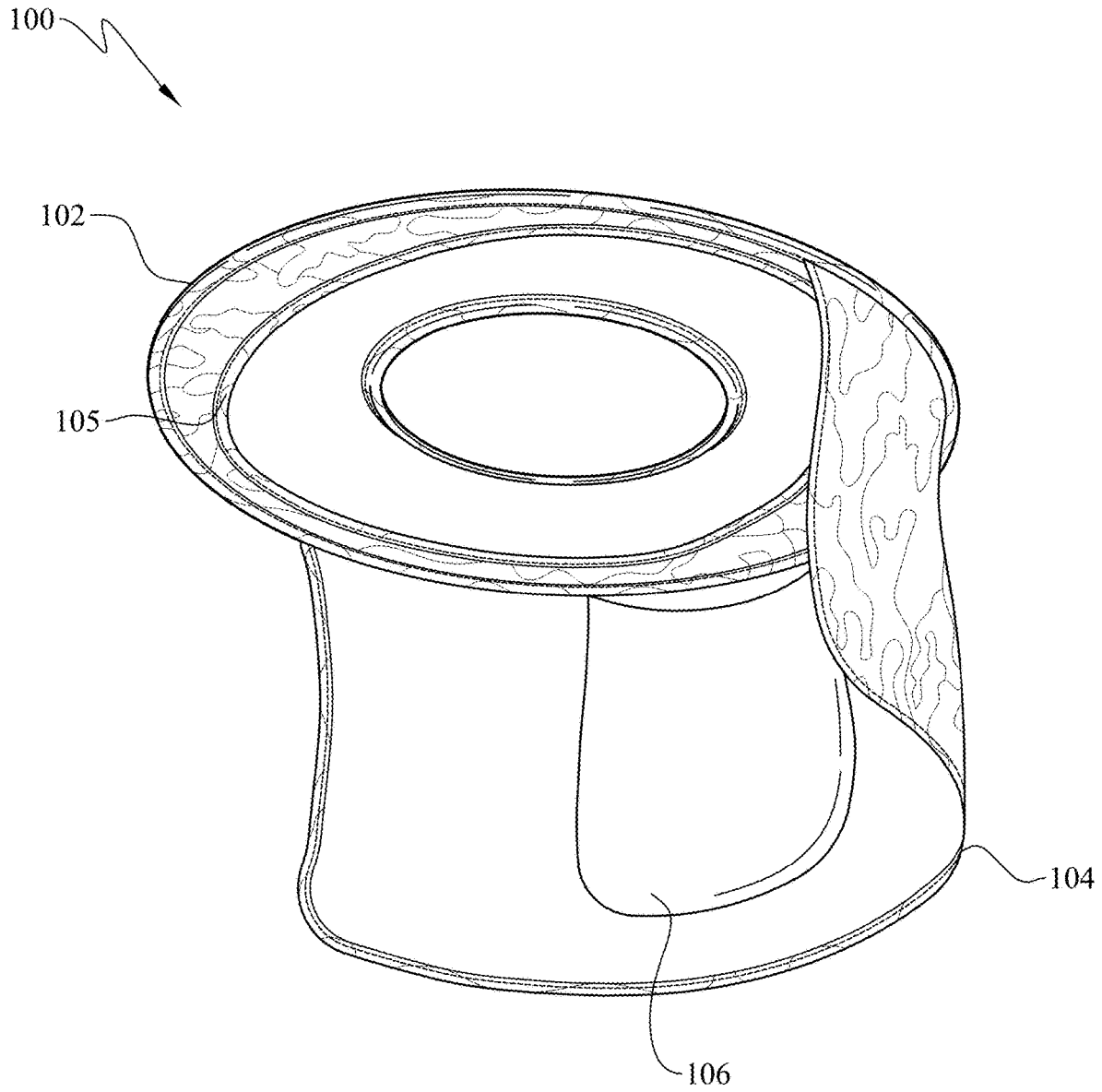
FIG. 3 presents a bottom perspective view of the removable cover illustrated in FIG. 1, shown with an inside surface of the cover containing a pouch in which the cover may fold into when not in use.

FIG. 3 presents a bottom perspective view of the removable cover 100 shown with an inside surface of the cover containing a pouch 106. The pouch 106 is built into the inside surface of the cover 100 and serves as a storage compartment for the cover when it is not in use. The pouch 106 can be created by sewing an additional piece of fabric onto the inside of the cover, forming a pocket-like structure.

The pouch 106 is conveniently positioned near the edge of the cover 100, allowing for easy insertion and retrieval of the folded cover. The pouch 106 can be accessed through a small opening or zipper, providing a secure closure when the cover is stored. The size of the pouch 106 is designed to accommodate the folded cover 100, ensuring a compact and space-efficient storage solution.

Figure 4:
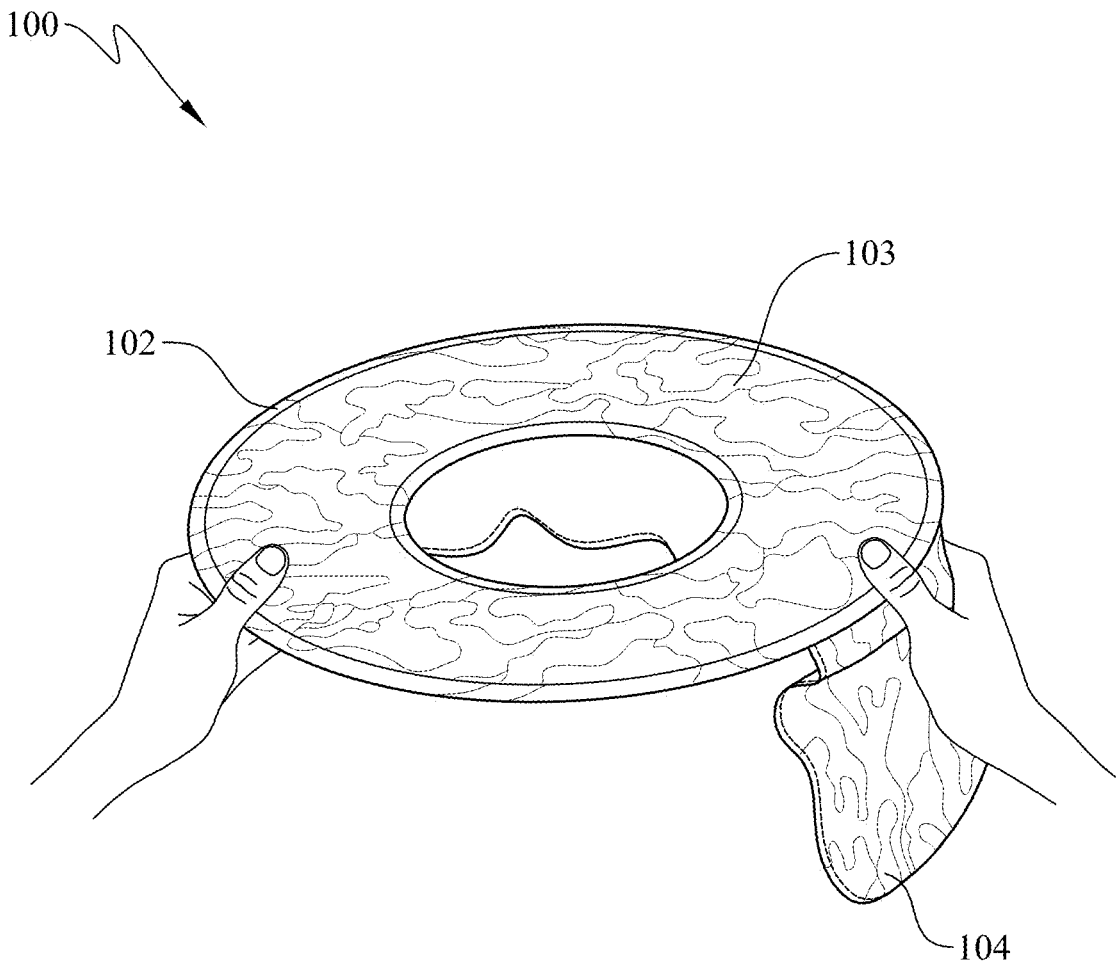
FIG. 4 presents a perspective view of the removable cover illustrated in FIG. 1, shown being removed from a straw hat, prior to folding.

In FIG. 4, a perspective view of the removable cover 100 is shown being removed from a straw hat. The attachment mechanism is released, allowing the cover 100 to be easily detached from the straw hat. The hook and loop fasteners, snap buttons, or magnetic closures can be conveniently disengaged, allowing the wearer to remove the cover with minimal effort.

Figure 5:
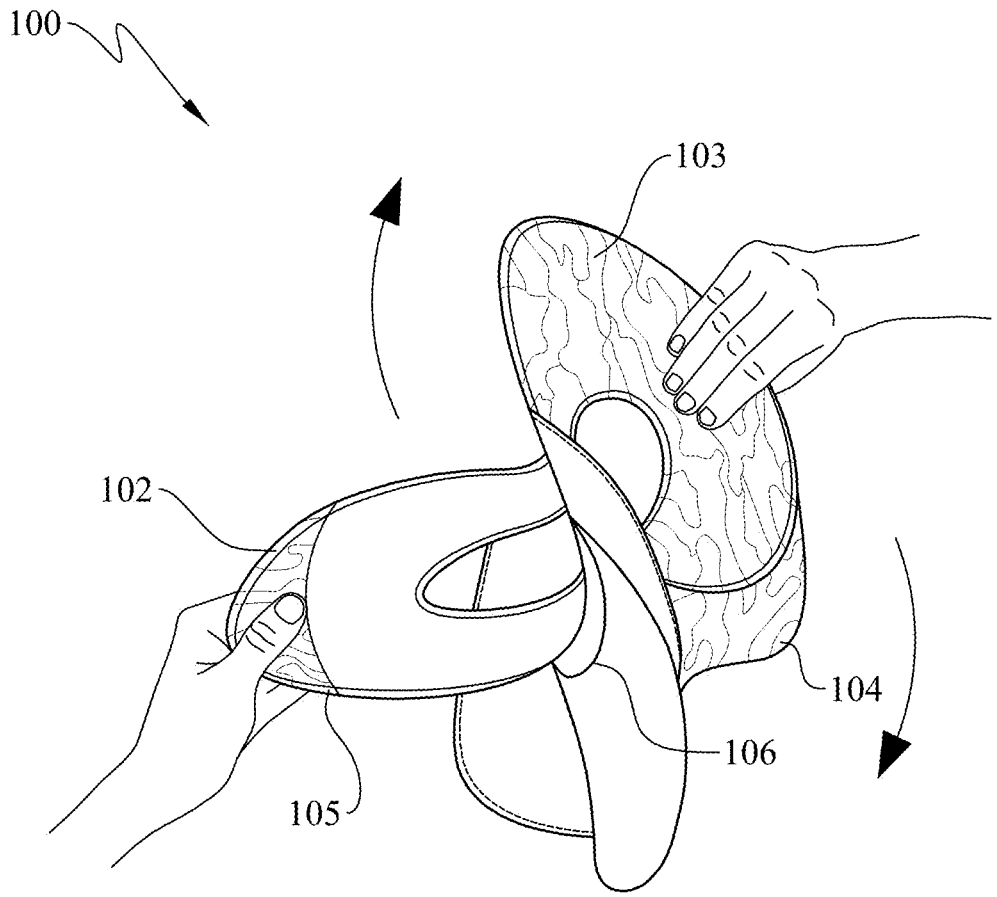
FIG. 5 presents a perspective view of the removable cover illustrated in FIG. 4, shown being removed from a straw hat and being folded for storing.

Once removed, the cover 100 can be folded for storing, as depicted in FIG. 5. The foldable design of the cover allows it to be neatly and compactly folded, reducing its size for convenient storage. The cover 100 can be folded in various ways, such as by folding the brim portion 102 in half or rolling the entire cover into a compact shape. The folding method may depend on personal preference or the size of the pouch 106.

Figure 6:
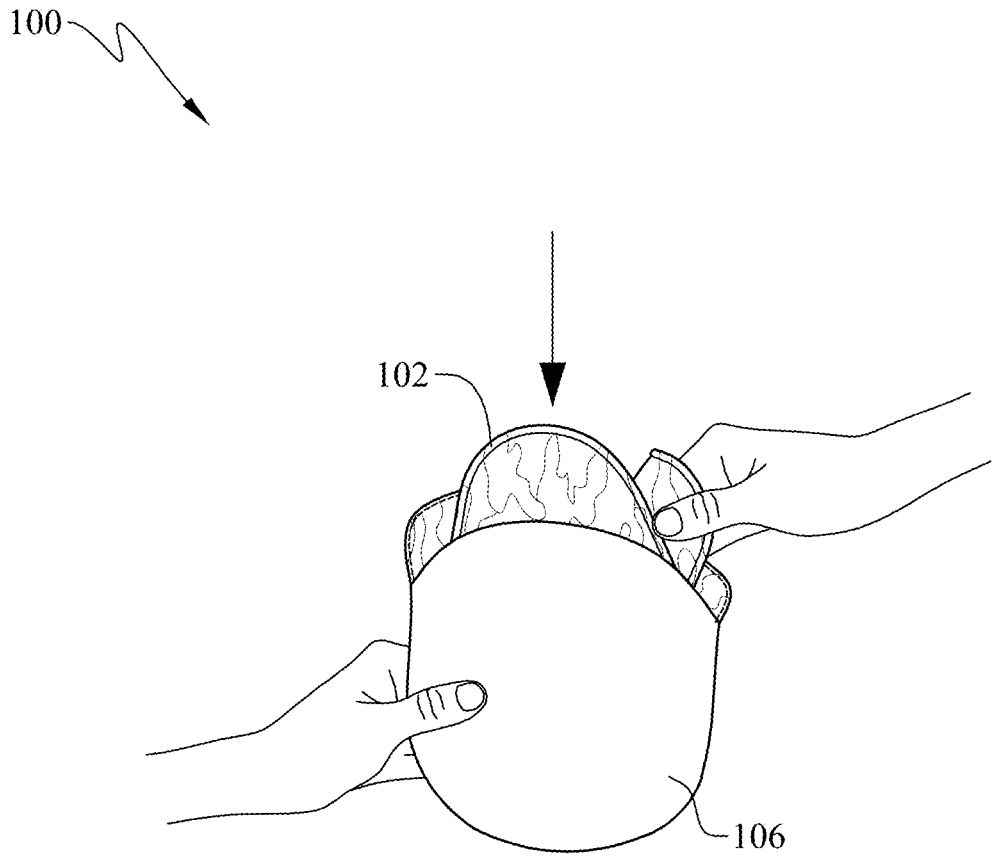
FIG. 6 presents a perspective view of the removable cover illustrated in FIG. 6, shown being removed from a straw hat and being folded for storing and being place in the pouch illustrated in FIG. 3.

FIG. 6 illustrates a perspective view of the removable cover 100 being removed from a straw hat and being folded for storage and placed in the pouch 106 illustrated in FIG. 3. After folding, the cover 100 can be conveniently inserted into the pouch 106, which serves as a dedicated storage compartment. The pouch 106 ensures that the folded cover remains protected from dirt, damage, and unintended unfolding. The cover 100 can be securely stored in the pouch 106, ensuring that it remains compact and readily available for future use.

Figure 7:
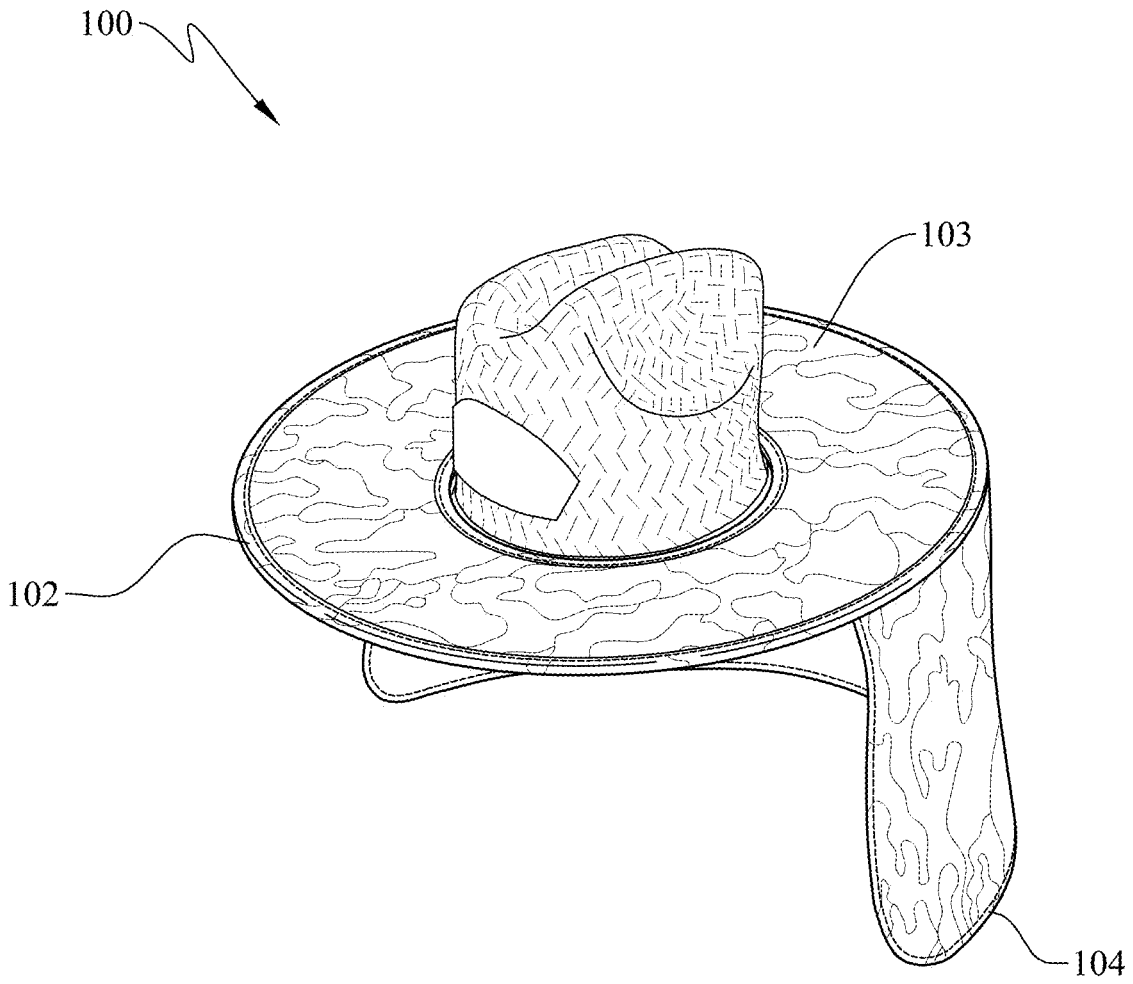
FIG. 7 presents a perspective view of the removable cover illustrated in FIG. 1, being shown place on a straw hat.

Finally, FIG. 7 presents a perspective view of the removable cover 100 being placed on a straw hat. The cover 100 is securely attached to the hat using the attachment mechanism, providing effective sun protection to the wearer's neck. The adjustable design of the cover 100 allows for resizing to fit different hat sizes and shapes, ensuring a universal fit and versatility.

To use the adjustable removable cover 100, a method can be followed which includes several steps. First, provide a straw hat equipped with the removable cover 100. Identify the preferred attachment mechanism, such as hook and loop fasteners, snap buttons, or magnetic closures, based on personal preference or the cover's configuration. Position the cover 100 over the straw hat, ensuring alignment with the hat's brim. Securely engage the attachment mechanism, whether by pressing hook and loop fasteners together, snapping buttons into place, or allowing magnetic closures to connect. Adjust the cover 100 for a secure and snug fit using adjustable features like a drawstring or elastic cord. Make sure the cover 100 covers both the top and bottom surfaces of the brim, providing thorough sun protection. The wearer can then engage in outdoor activities while benefiting from the cover's protection. When sun protection is no longer needed, disengage the attachment mechanism to remove the cover 100. Fold the cover 100 as desired, and store it in the dedicated pouch 106, keeping it protected and accessible for future use.

By following this method of use, users can effectively and conveniently utilize the adjustable removable cover 100 to protect their necks from the sun's harmful rays while enjoying the comfort and style of a straw hat. The adjustability, secure attachment mechanism, and dedicated storage pouch enhance the overall convenience and usability of the cover 100.

In addition to the described embodiment, various alternate embodiments of the present invention are also contemplated. For instance, the attachment mechanism can be implemented using different fastening systems, such as buttons, clips, or adhesive strips, depending on the specific requirements and user preferences. Furthermore, the fabric material of the removable cover can be varied to cater to different needs, including variations in thickness, texture, or additional functional properties like water resistance or flame retardancy. The design of the cover can also be modified to incorporate additional features, such as ventilation panels or integrated cooling elements to enhance wearer comfort in hot weather conditions. Additionally, while the present invention has been primarily described in relation to straw hats, it should be understood that the adjustable removable cape/cover can be adapted to fit and provide sun protection for other types of hats or headwear. These alternate embodiments and variations provide flexibility in customization and address specific needs or preferences of individual users, expanding the application and utility of the present invention in a wide range of scenarios.

In summary, the adjustable removable cover 100 for sun protection on straw hats provides a comprehensive solution to shield the wearer's neck from the sun's harmful rays. With features such as semipermeable and stretchy fabric material, quick-drying properties, adjustable design, secure attachment mechanism, and a dedicated storage pouch, the cover offers comfort, functionality, and versatility. The specific configuration and arrangement of the top portion, bottom portion, and the neck portion of the cover, along with the pouch on the inside surface of the hanging portion, provide a practical and efficient sun protection solution for straw hat wearers.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An adjustable and removable cover for sun protection on straw hats comprising:

a semipermeable and stretchy fabric material configured to shield the wearer's neck from direct sunlight;

an attachment mechanism adapted for secure and easy fastening of the cover to a brim of the straw hat;

an adjustable design allowing for resizing and accommodating various hat sizes and shapes; wherein the cover is completely removable, enabling users to attach or detach it as desired, and wherein the cover is configured to enclose both a top and bottom surface of the brim to provide comprehensive sun protection; and a storage pouch formed along an interior surface of the cover, the storage pouch being dimensioned to receive the cover in a folded configuration when not in use.

2. The adjustable removable cover of claim 1, wherein the semipermeable and stretchy fabric material is quick-drying.

3. The adjustable removable cover of claim 2, wherein the fabric material comprises a UV-protective coating.

4. The adjustable removable cover of claim 3, wherein the fabric material comprises a UPF (Ultraviolet Protection Factor) rating.

5. The adjustable removable cover of claim 1, wherein the attachment mechanism comprises hook and loop fasteners.

6. The adjustable removable cover of claim 1, wherein the attachment mechanism comprises snap buttons.

7. The adjustable removable cover of claim 1, wherein the attachment mechanism comprises magnetic closures.

8. The adjustable removable cover of claim 1, wherein the adjustable design includes a drawstring or elastic cord for resizing.

9. The adjustable removable cover of claim 8, wherein the adjustable design includes adjustable straps or buckles for resizing.

10. The adjustable removable cover of claim 1, wherein the fabric material comprises a moisture-wicking property.

11. The adjustable removable cover of claim 10, wherein the fabric material comprises antimicrobial properties.

12. The adjustable removable cover of claim 1, wherein the fabric material comprises a lightweight and breathable mesh construction.

13. The adjustable removable cover of claim 1, wherein the cover includes customization options with a variety of colors.

14. The adjustable removable cover of claim 13, wherein the customization options include patterns or prints.

15. The adjustable removable cover of claim 14, wherein the customization options include embroidered designs.

16. The adjustable removable cover of claim 14, wherein the customization options include interchangeable decorative patches or accessories.

17. An adjustable and removable cover for sun protection on straw hats comprising:

a semipermeable and stretchy fabric material configured to shield the wearer's neck from direct sunlight;

an attachment mechanism adapted for secure and easy fastening of the cover to the straw hat;

an adjustable design allowing for resizing and accommodating various hat sizes and shapes; wherein the cover is completely removable, enabling users to attach or detach it as desired;

the cover is configured to enclose both a top and bottom surface of the brim to provide comprehensive sun protection; and a storage pouch formed along an interior surface of the cover, the storage pouch being dimensioned to receive the cover in a folded configuration when not in use.

18. An adjustable and removable cover for sun protection on straw hats comprising:

a quick-drying, semipermeable and stretchy fabric material configured to shield the wearer's neck from direct sunlight, the fabric material further comprising a moisture-wicking and an antimicrobial properties having a mesh construction;

an attachment mechanism adapted for secure and easy fastening of the cover to the straw hat, wherein the attachment mechanism is selected from a group comprising hook and loop fasteners, snap buttons, and magnetic closures;

an adjustable design allowing for resizing and accommodating various hat sizes and shapes; wherein the cover is completely removable, enabling users to attach or detach it as desired;

the cover is configured to enclose both a top and bottom surface of the brim to provide comprehensive sun protection; and a storage pouch formed along an interior surface of the cover, the storage pouch being dimensioned to receive the cover in a folded configuration when not in use.

* * * * *